US010995559B2

(12) United States Patent
Radicioni et al.

(10) Patent No.: US 10,995,559 B2
(45) Date of Patent: May 4, 2021

(54) COUPLING SYSTEM BETWEEN A RISER AND AN UNDERWATER SUPPORTING STRUCTURE

(71) Applicant: SAIPEM S.P.A., Milano (IT)

(72) Inventors: Alessandro Radicioni, Milan (IT); Otavio Serta, Milan (IT); Giovanni Moreschi, Milan (IT); Alessandro Filippi, Milan (IT)

(73) Assignee: SAIPEM S.P.A., San Donato Milanese (IT)

( * ) Notice: Subject to any disclaimer, the term of this patent is extended or adjusted under 35 U.S.C. 154(b) by 0 days.

(21) Appl. No.: 16/497,153

(22) PCT Filed: Mar. 19, 2018

(86) PCT No.: PCT/IB2018/051800
§ 371 (c)(1),
(2) Date: Sep. 24, 2019

(87) PCT Pub. No.: WO2018/172900
PCT Pub. Date: Sep. 27, 2018

(65) Prior Publication Data

US 2020/0386058 A1 Dec. 10, 2020

(30) Foreign Application Priority Data

Mar. 24, 2017 (IT) ..... 102017000032863

(51) Int. Cl.
*E21B 17/01* (2006.01)
*E21B 17/08* (2006.01)

(52) U.S. Cl.
CPC ..... *E21B 17/012* (2013.01); *E21B 17/085* (2013.01)

(58) Field of Classification Search
CPC ..... E21B 17/012; E21B 17/085; E21B 17/02
See application file for complete search history.

(56) References Cited

U.S. PATENT DOCUMENTS 4,068,868 A 1/1978 Ohrt
4,199,275 A * 4/1980 Tuson ..... B63B 35/4406 405/195.1

(Continued)

FOREIGN PATENT DOCUMENTS

GB 1 143 010 A 2/1969
WO 02/066786 A1 8/2002

(Continued)

OTHER PUBLICATIONS

International Search Report and Written Opinion of the International Searching Authority for International Patent Application No. PCT/IB2018/051800 dated Jun. 20, 2018, 12 pages.

*Primary Examiner* — James G Sayre
(74) *Attorney, Agent, or Firm* — Merchant & Gould P.C.

(57) ABSTRACT

A coupling system (12) between a riser (2) and an underwater supporting structure (10), includes a coupling seat (13) and a coupling head (14) which can be inserted in the seat. A pull connector (16) constrains the head (14) to the seat (13) to prevent the extraction of the head (14) but to allow rotation of the head (14). A clamping connector (18) constrains the head (14) to the seat (13) to prevent transversal translation and rotation to the head (14) and the seat (13). The pull connector (16) can be actuated alone and independently from the clamping connector (18) to make a provisional, pull-only connection between the head (14) and the coupling seat (13). The clamping connector (18) can be actuated independently from the pull connector (16) to allow postponing the complete clamping with respect to the provisional connection.

17 Claims, 11 Drawing Sheets

(56) References Cited

U.S. PATENT DOCUMENTS

| | | | | | |
|---|---|---|---|---|---|
| 4,439,055 | A * | 3/1984 | Quigg | B63B 21/502 | 403/330 |
| 4,943,188 | A * | 7/1990 | Peppel | B63B 21/502 | 114/294 |
| 6,557,637 | B1 * | 5/2003 | Dore | E21B 17/085 | 166/338 |
| 8,919,448 | B2 | 12/2014 | Dziekonski | | |
| 2015/0152694 | A1 * | 6/2015 | DeBerry | E21B 19/002 | 166/344 |

FOREIGN PATENT DOCUMENTS

| | | | | | |
|---|---|---|---|---|---|
| WO | 03/095788 | A1 | 11/2003 | | |
| WO | 2009/102220 | A2 | 8/2009 | | |
| WO | WO-2009102220 | A2 * | 8/2009 | E21B 17/085 | |
| WO | 2012/151060 | A2 | 11/2012 | | |
| WO | WO-2012151060 | A2 * | 11/2012 | E21B 33/038 | |

* cited by examiner

COUPLING SYSTEM BETWEEN A RISER AND AN UNDERWATER SUPPORTING STRUCTURE

This application is a National Stage Application of PCT/IB2018/051800, filed 19 Mar. 2018, which claims benefit of Ser. No. 10/2017/000032863, filed 24 Mar. 2017 in Italy, and which applications are incorporated herein by reference. To the extent appropriate, a claim of priority is made to each of the above-disclosed applications.

The present invention relates to a coupling system between a riser and an underwater supporting structure.

FIELD OF THE ART

In a typical offshore oil and natural gas extraction set-up in deep and ultra-deep waters on the order of hundreds to thousands of meters, for example 500 meters-4000 meters, one or more floating units perform the function of a production platform and are connected to a well, to an installation or to a general area of concern on the seabed, via risers, provided for one or more specific functions, e.g. for conveying petroleum or natural gas, etc.

Risers are elongated structures with a very slender longitudinal extension, which may be made of a substantially rigid, flexible, elastic, elastoplastic, metal (in particular steel) or composite material, e.g. reinforced with fibers, and can be installed, for example, in a catenary free-hanging or erected free-standing configuration.

Examples of floating production platforms are tension leg platforms (TLP), deep draft floating caisson type vessels (SPAR), semi-submersible production vessels (SEMI) or so-called floating production storage and offloading units (FPSO). The motion responses of the floating platforms to the stresses of wind, waves and marine currents, as well as their propulsive movement, induce displacements and stresses in the risers and in the structures connected thereto on the seabed. The points most subject to dynamic stresses are the coupling zones at the upper and lower ends of the riser.

A design requirement of the risers and their connections to the respective supporting structures (firstly, the floating platform and the structure on the seabed) is therefore to manage and reduce the stresses induced by the motion of the floating platform and by sea currents.

An installation method of the risers which considerably reduces movements and mechanical stresses, in particular at the lower end of the riser, is the co-called FSHR (free standing hybrid riser) installation, in which an approximately vertical or erected rigid riser section is anchored onto the seabed and tensioned upwards (i.e. in nearly static condition) by a floating body, and in which a second flexible pipe section connects an upper end of the rigid riser section to the floating platform so as to absorb the effects of relative dynamic motion between the rigid riser section (riser) and the floating platform.

A top riser coupling assembly (TRA) provides the connection between the upper flexible pipe section, the rigid riser section and the floating body. A lower riser coupling assembly (LRA) provides the connection between the rigid riser section, a base foundation and a pipeline on the seabed.

Among the various connections of the riser, the most problematic is the so-called lower interface between the rigid riser section and the pipeline on the seabed. This interface is achieved with a rigid tube section (spool) but is configured with a shape (e.g. a serpentine) which gives it the flexibility needed to be deformable during the movements of the rigid riser section. On one hand, in order to avoid stress peaks due to the impeded movements of the riser, it would be desirable to make a lower serpentine interface which is only little stiff. On the other hand, in order to avoid a complicated design which is difficult to manufacture and install, it would be desirable to make a simpler, and therefore stiffer, serpentine interface.

A rigid clamping anchoring of the lower end portion of the riser in the base foundation on the seabed would considerably reduce the movements of such end portion, and thus the strain peaks and the fatigue stresses in the interface between the riser and the pipeline on the seabed. On the other hand, a rigid clamping anchoring of the end portion of the riser would require a very rigid, massive and large foundation base, the construction of which would be very expensive in terms of cost and time. With this regard, it is worth noting that the maximum stress of the base foundation and of the lower end portion of the riser occurs during the engagement and the rigid coupling between them, when the riser is actively moved (in translation and in rotation) and is not yet in its quasi static working configuration. When the rigid clamping between the riser and the base foundation and the upward tensioning of the riser by means of the floating body is completed, the base foundation is much less stressed, and therefore would be over-dimensioned for all the remaining duration of use.

In particular, mechanical strength considerations would require a low stiffness solution to avoid high strains in the case of the movements of the end of the rigid tube section (spool), while the need to avoid a dynamic coupling with the riser, in order to reduce fatigue damage, would require a high rigidity design.

These and other conflicting requirements are not solved to date.

Known Solutions

FSHR installations have been proposed, made or tested, in which a hinge is made on the side of the base foundation or on the side of the lower end portion of the riser or in the coupling interface between the riser and the base foundation and/or in the lower serpentine interface.

Examples of FSHR installations have been published in U.S. Pat. Nos. 8,919,448, 4,068,868, 4,439,055, 4,943,188, WO02066786 and WO03095788. WO03095788 describes a FSHR installation with a flexible hinge at the lower end of the riser and a horizontal translation track in the base foundation.

The anchoring of the riser by interposing hinges allows the nearly free transmission of mechanical stresses and movements (or decreases the mechanical stresses and damps the movements) from the riser to the lower spool interface with the pipeline on the seabed, increases the structural and connection complexity between the riser and the spool, subjects the connectors of the spool to fatigue stresses and displays problems of premature wear of the elastomeric parts of the hinges in service.

Therefore, it is the object of the invention to provide coupling systems between a riser and an underwater supporting structure having features such as to reconcile the conflicting needs of the offshore applications described in the introduction.

It is a particular object of the invention to provide coupling systems between a riser and an underwater supporting structure, having features such to reduce the mechanical stresses of the underwater supporting structure (e.g. a base foundation) during the engagement and rigid clamping with the riser, in order to reduce weight, cost and size of the supporting structure.

It is a further particular object of the invention to provide coupling systems between a riser and an underwater supporting structure, having features such as to allow a rigid clamping of the riser in the underwater supporting structure (e.g. a base foundation), without however requiring an oversizing of the supporting structure to withstand the anomalous stresses during step of installing of the riser.

It is a further object of embodiments of the invention to provide a connection system which does not transfer rotations to the base of the riser and which makes it possible to design a traditional shape connection which is easier to install.

It is a yet further object of embodiments of the invention to provide a connection system which makes it possible to adequately transfer the loads to the traditional type foundations, in particular foundations made of suction piles installable by pipe laying means and without the assistance of drilling means and techniques.

GENERAL DESCRIPTION OF THE INVENTION a coupling seat and a coupling head, one formed or connectable to the underwater supporting structure and the other to the riser, wherein the coupling head and the coupling seat are shaped for a mutual insertion thereof along an insertion direction from a completely detached position to an inserted position, a pull connector adapted to constrain the coupling head to the coupling seat, in a coupling region, so as to prevent the extraction of the coupling head along the insertion direction towards the detached position, but so as to allow rotations of the coupling head with respect to the coupling seat at least about axes transversal to the insertion direction, a clamping connector adapted to constrain the coupling head to the coupling seat, in at least one locking region spaced apart from the coupling region, so as to prevent translations transversal to the insertion direction and rotations between the head and the coupling seat, wherein the pull connector and the clamping connector make together a complete clamping of the coupling head in the coupling seat with prevention of relative rotations therebetween, wherein the pull connector can be actuated alone and independently from the clamping connector to make a provisional pull-only connection between the head and the coupling seat, wherein the clamping connector can be actuated after the actuation of the pull connector in order to be able to postpone the complete clamping with respect to the provisional connection.

The provisional pull-only connection avoids excessive stresses of the supporting structure (in particular, the base foundation) and of the riser during their mutual engagement maneuvers, thus avoiding a structural oversizing thereof.

During the successive step of operation, in which the riser is no longer subject to positioning movements and is tensioned in nearly static condition by the floating body, the complete activation of the clamping connector reduces the maximum strains and the fatigue stresses induced by the riser on other installations connected to it, e.g. the spool interface with a pipeline on the seabed.

The technical effects which can be achieved by the invention have been explained hereto by means of a single example of application of the system but the possibility of freely modifying the type of constraint is advantageous also for different underwater applications, e.g. during the connecting operations of the upper end portion of the riser to the upwards tensioning float.

BRIEF DESCRIPTION OF THE DRAWINGS

In order to better understand the invention and appreciate the advantages thereof, some non-limiting exemplary embodiments will be described below with reference to the drawings, in which.

DETAILED DESCRIPTION OF EMBODIMENTS

Figure 1:
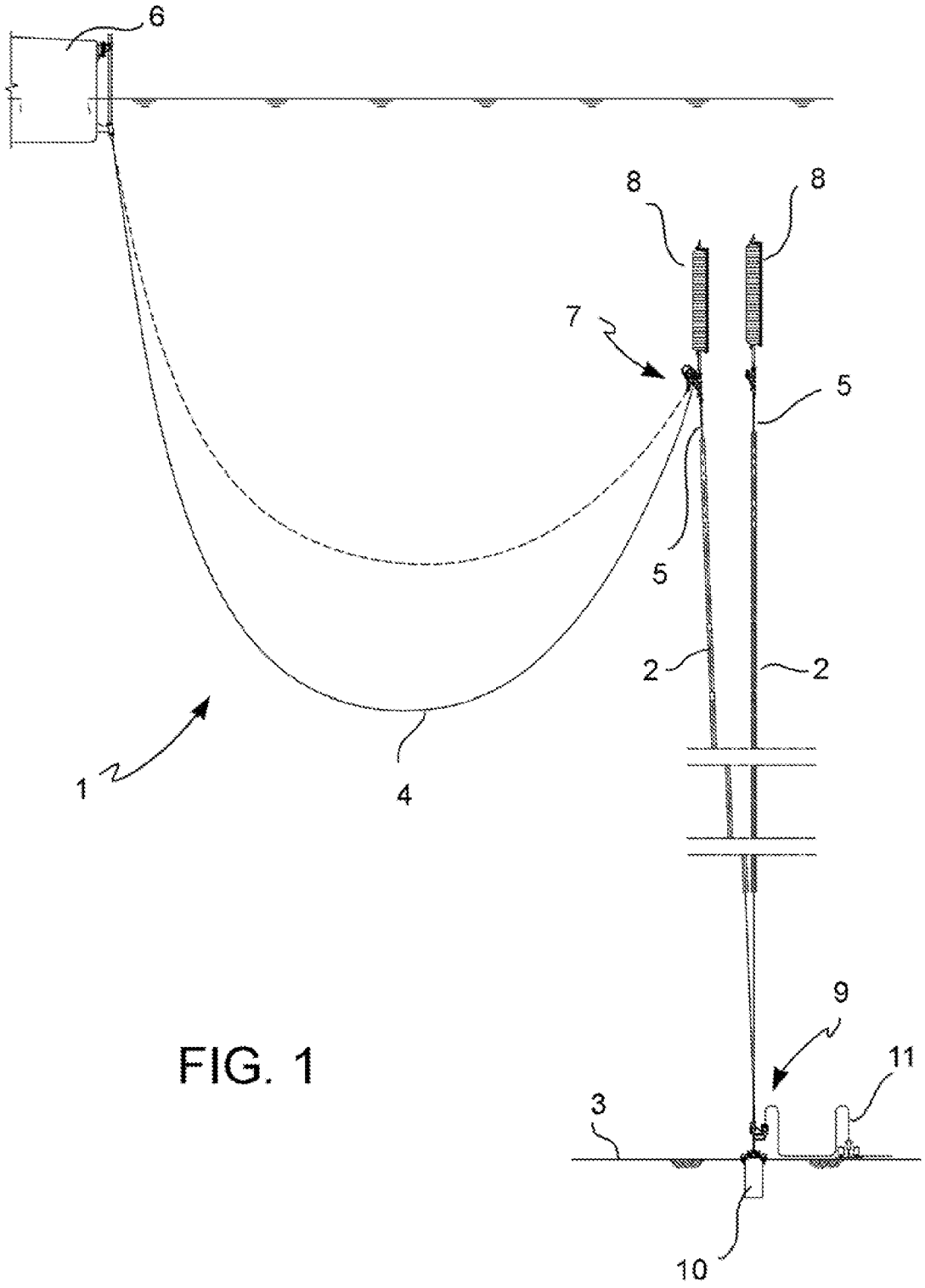
FIG. 1 PRIOR ART
FIG. 1 shows an exemplary FSHR installation.
Figure 2:
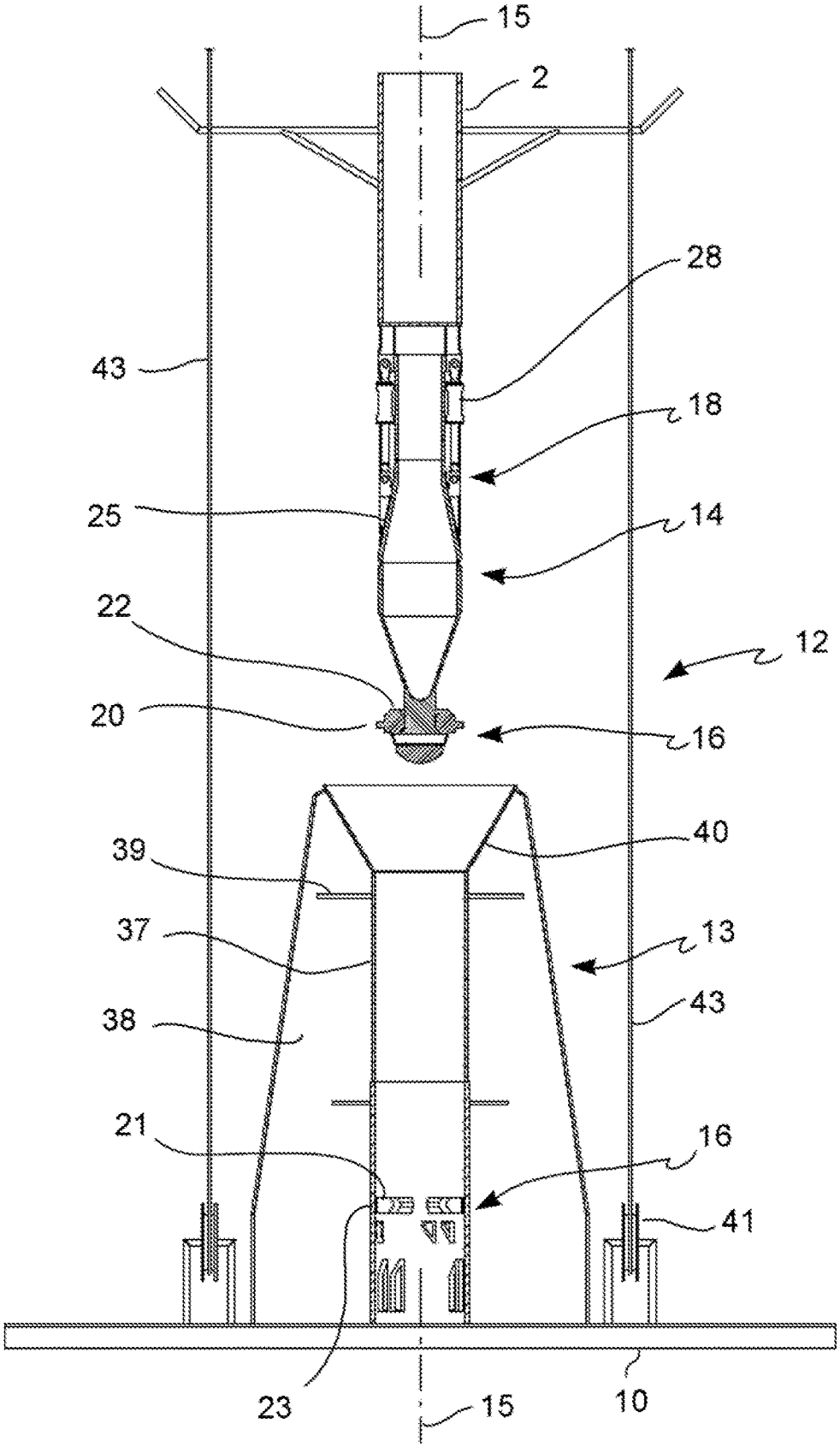
FIGS. 2 and 3 are longitudinal section views of a coupling system in detached position (FIG. 2) and inserted position (FIG. 3), according to an embodiment.

FIG. 1 illustrates an offshore installation 1 of the FSHR (free standing hybrid riser) type, in which an approximately vertical or erected rigid riser duct 2 is anchored to the seabed 3 and tensioned upwards (and thus in nearly static condition) by means of a floating body 8, and in which a further flexible pipe section 4 connects an upper end 5 of the rigid riser duct 2 to a floating platform 6 so as to absorb the relative dynamic motion effects between the rigid riser duct 2 and the floating platform 6.

A top riser coupling assembly (TRA) 7 provides the connection between the (upper) flexible pipe duct 4, the rigid riser duct 2 and the floating body 8. A lower riser coupling assembly 9 (LRA) provides the connection between the rigid riser duct 2, a base foundation 10 and a pipeline 11 on the seabed 3.

The top riser coupling assembly 7 and lower riser coupling assembly 9, the floating body 8 and the base foundation 10 are non-limiting examples of a general underwater supporting structure, e.g. a base foundation 10 and the rigid riser duct 2 are a non-limiting example of a general underwater riser 2, to which reference is made in the following detailed description of the invention.

Figure 3:
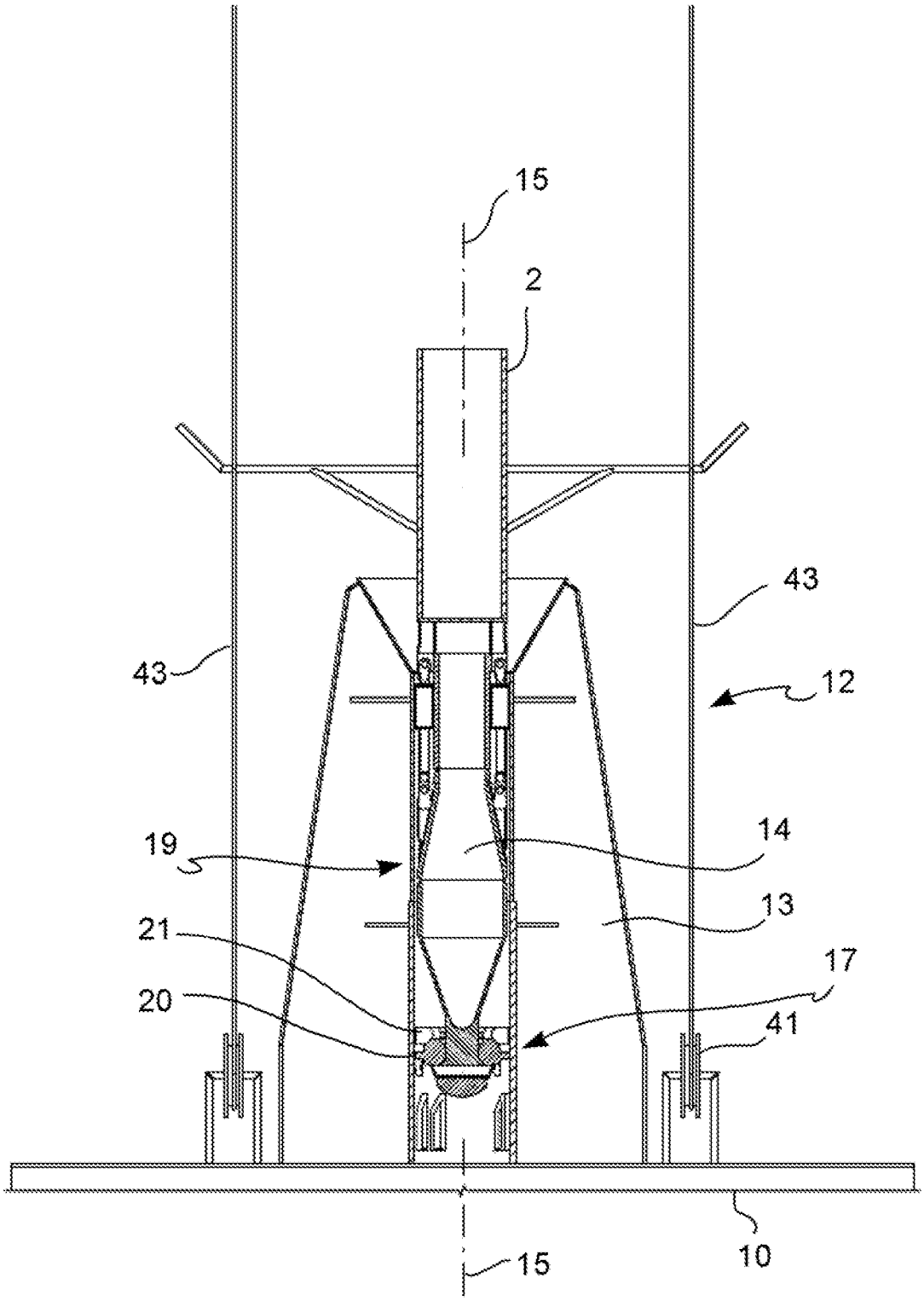

FIGS. 2-5 show a coupling system 12 between the riser 2 and the underwater supporting structure 10 according to a first embodiment. The system 12 comprises a coupling seat 13 and a coupling head 14, formed or connectable (preferably rigidly) one to the underwater supporting structure 10 and the other to the riser 2. The coupling head 14 and the coupling seat 13 are shaped for a mutual, preferably guided, insertion along an insertion direction 15 from a completely detached position (FIG. 2) to an inserted position (FIG. 3).

The system 12 comprises a pull connector 16 adapted to constrain the coupling head 14 to the coupling seat 13, in a coupling region 17, so as to prevent the extraction of the coupling head 14 along the insertion direction 15 towards the detached position, but so as to allow rotations of the coupling head 14 with respect to the coupling seat 13 at least about axes transversal to the insertion direction 15.

The system 12 further comprises a clamping connector 18 adapted to constrain the coupling head 14 to the coupling seat 13, in at least one locking region 19 spaced apart from the coupling region 17, so as to prevent translations transversal to the insertion direction 15 and rotations between the head 14 and the coupling seat 13.

The pull connector 16 and the clamping connector 18 are adapted to make together a complete clamping of the coupling head 14 in the coupling seat 13 with prevention of relative rotations therebetween.

The pull connector 16 can be actuated alone and independently from the clamping connector 18 to make a provisional, pull-only connection between the head 14 and the coupling seat 13.

The clamping connector 18 can be actuated independently from the pull connector 16 to allow postponing the complete clamping with respect to the provisional connection.

The provisional pull-only connection avoids excessive stresses of the supporting structure 10 and of the riser 2 during their mutual engagement maneuvers, thus avoiding the structural oversizing thereof.

During a successive step of operating, e.g. during a step of production or exploration of an offshore oil well, in which the riser 2 is no longer subject to positioning movements and is tensioned in nearly static condition by the floating body 8, the complete activation of the clamping connector reduces the maximum strains and the fatigue stresses induced by the riser 2 on other installations connected to it, e.g. the spool interface with the pipeline 11 on the seabed 3.

Detailed Description of the Pull Connector 16

In an embodiment, the pull connector 16 comprises one or more hooking members 20 (e.g. protuberances and/or recesses) either formed or positioned in a hooking portion 22 of the coupling head 14 and adapted to engage one or more corresponding latching members 21 (e.g. protuberances and/or recesses) either formed or arranged in a latching portion 23 of the coupling seat 13.

The latching members 21 form an abutment for a free resting of the hooking members 20 in the extraction direction of the coupling head 14 but to allow a movement thereof in the opposite direction (insertion direction), so as to provide the clearance needed to allow nonetheless rotations or angular orientations of the coupling head 14 about axes transversal to the insertion direction 15.

As apparent from the figures, the freedom of rotation of the head 14 received in the coupling seat 13 is not necessarily allowed in a wide angular range and can be limited by the geometry of the coupling seat 13, which is selected according to the rotation amplitude of the head 14 which is desired to be allowed in the provisional, pull-only connection condition.

In an embodiment, in order to prevent violations of space during the insertion of the head 14 in the seat 13, the hooking members 20 may be displaced with respect to the head 14 and/or the latching members 21 can be displaced with respect to the seat 13, from a rest (e.g. retracted) position to a working (e.g. protracted) position.

In this case, the pull connector 16 may comprise actuating means to move the hooking members 20 and/or the latching members 21 between the resting and the working positions, e.g. one or more hydraulic actuators or lever mechanisms, which can be actuated remotely, e.g. by means of a remotely operated underwater vehicle (ROV).

Figure 14:
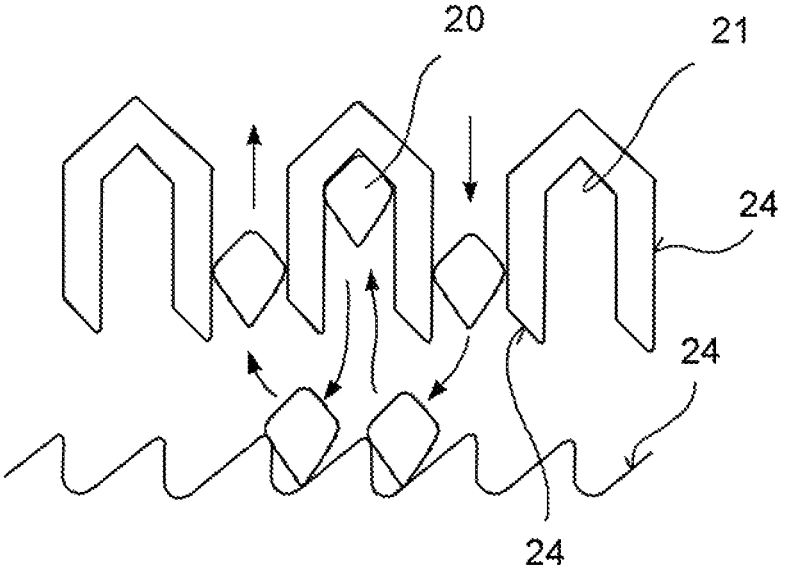
FIG. 14 shows a geometric detail of a pull connector of the coupling system according to an embodiment.

In an alternative embodiment, in order to avoid the complexities of actuating mechanisms, the hooking members 20 and the latching members 21 may be stationary and the pull connector 16 may comprise guiding surfaces, e.g. of the labyrinth type (FIG. 14) for a controlled engagement, e.g. by means of a relative roto-translational movement, of the hooking members 20 and of the latching members 21.

In the case of a guided roto-translational engagement of the hooking members 20 and of the latching members 21, the entire hooking portion 22 of the head 14 or the entire latching portion 23 of the seat 13 can be made in rotatable manner about the insertion axis 15. In this manner, it is possible to avoid the need to turn or twist the riser 2 about its longitudinal axis, which corresponds to the insertion axis 15.

According to an embodiment, the coupling portion 22 is formed at a free end of the coupling head 14, tapered with respect to a locking portion 25, which will be described below.

Detailed Description of the Clamping Connector 18

In an embodiment, the clamping connector 18 comprises one or more expansion members 26 positioned in a locking portion 25 of the coupling head 14 and displaceable between a retracted position (FIGS. 4, 6, 11), in which they do not prevent the head 14 from moving in the seat 13, and a protracted position (FIG. 5, 7, 12), in which they expand the (radial) dimension of the head 14 with pressing contact against a locking surface 27 of the coupling seat 13 to achieve the complete clamping.

In an alternative embodiment (not shown), the clamping connector 18 comprises one or more expansion members positioned in a locking portion of the coupling seat 13 and displaceable between a retracted position, in which they do not prevent the head 14 from moving in the seat 13, and a protracted position, in which they (radially) narrow the seat 13 with pressing contact against a locking surface of the coupling seat 14 to achieve the complete clamping.

In an embodiment (FIGS. 4 and 5), the clamping connector 18 comprises actuating means 28 to displace the expansion members 26 between the retracted position and the protracted position, e.g. one or more linear actuators, preferably hydraulic actuators (cylinder-piston), screw jacks or lever mechanisms, which can be operated remotely, e.g. by means of a remotely operated underwater vehicle (ROV).

In order to reduce as much as possible the radial dimension of the coupling head 14 (or coupling seat 13, where applicable) and still ensure a sufficiently long travel or stroke of the actuating means 28 to apply the clamping force necessary for clamping the head 14 in the coupling seat 13, the actuating means 28 preferably act in the longitudinal direction of the coupling head 14 which corresponds to the insertion direction 15, and deviating means 29, e.g. inclined surfaces, are provided to convert the longitudinal thrust of the actuating means 28 into a radial or transversal thrust of the expansion members 28 against the locking surface 27.

In one embodiment (FIGS. 4 and 5), the expansion members 26 comprise one or more blocks or plates (preferably made of steel), preferably, one or more pairs of diametrically opposed plates or blocks, arranged in a sliding manner on sliding tracks 30 inclined so as to diverge in such a way that a displacement of the plates along the insertion direction 15 (either in or against the insertion direction of the head 14 in seat 13) involves a radial displacement thereof in pressing contact against the locking surface 27. Advantageously, the plates are wedge-shaped, e.g. with internal surfaces 31 of shape and orientation compatible with the shape and the orientation of the sliding track 30, and with external surfaces 32 of shape and orientation compatible with the shape and orientation of the locking surface 27.

Figure 6:
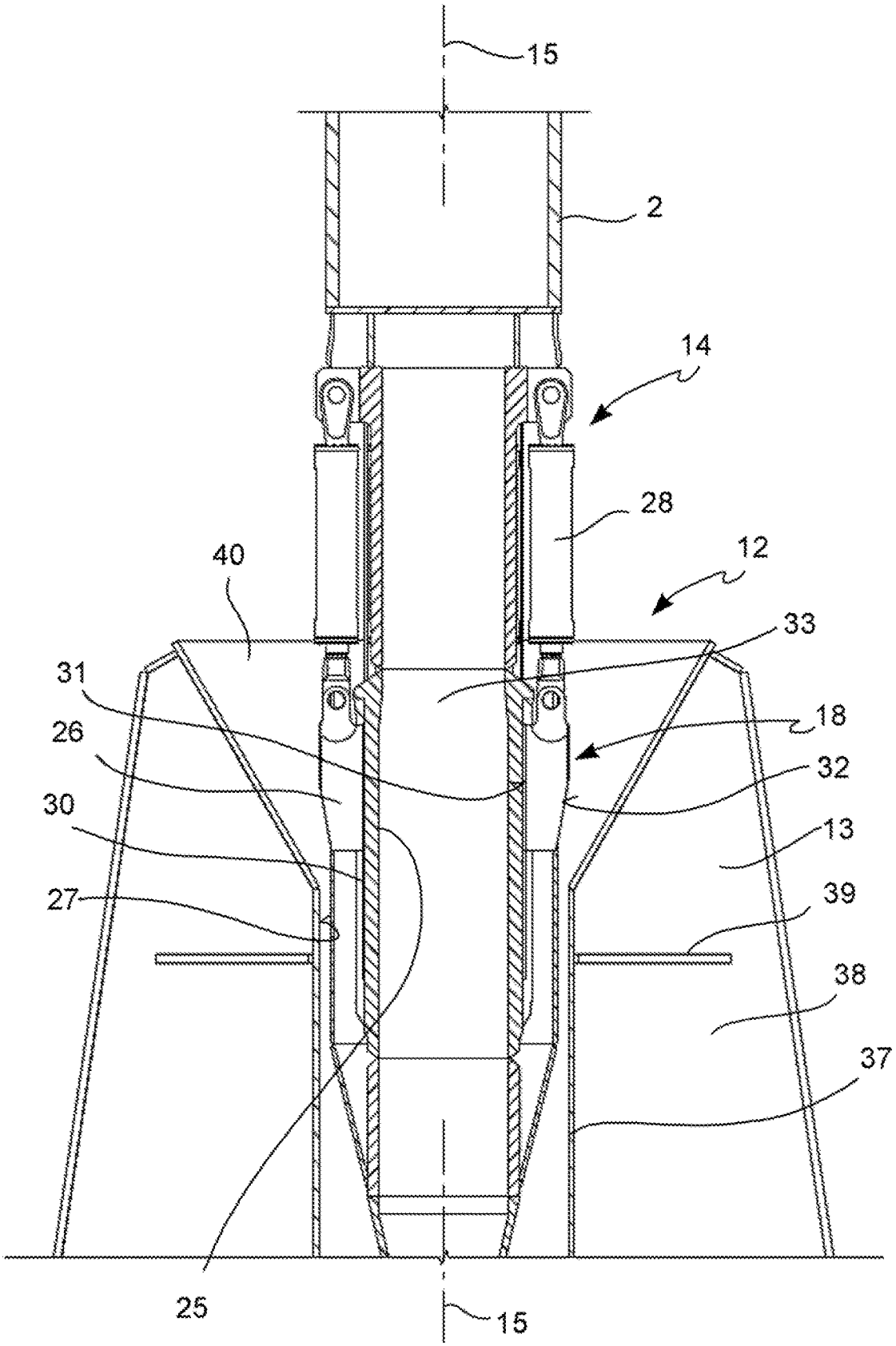
FIGS. 6 and 7 show a clamping connector of the coupling system according to another embodiment, in deactivated configuration (FIG. 6) and in activated configuration (FIG. 7)
Figure 7:
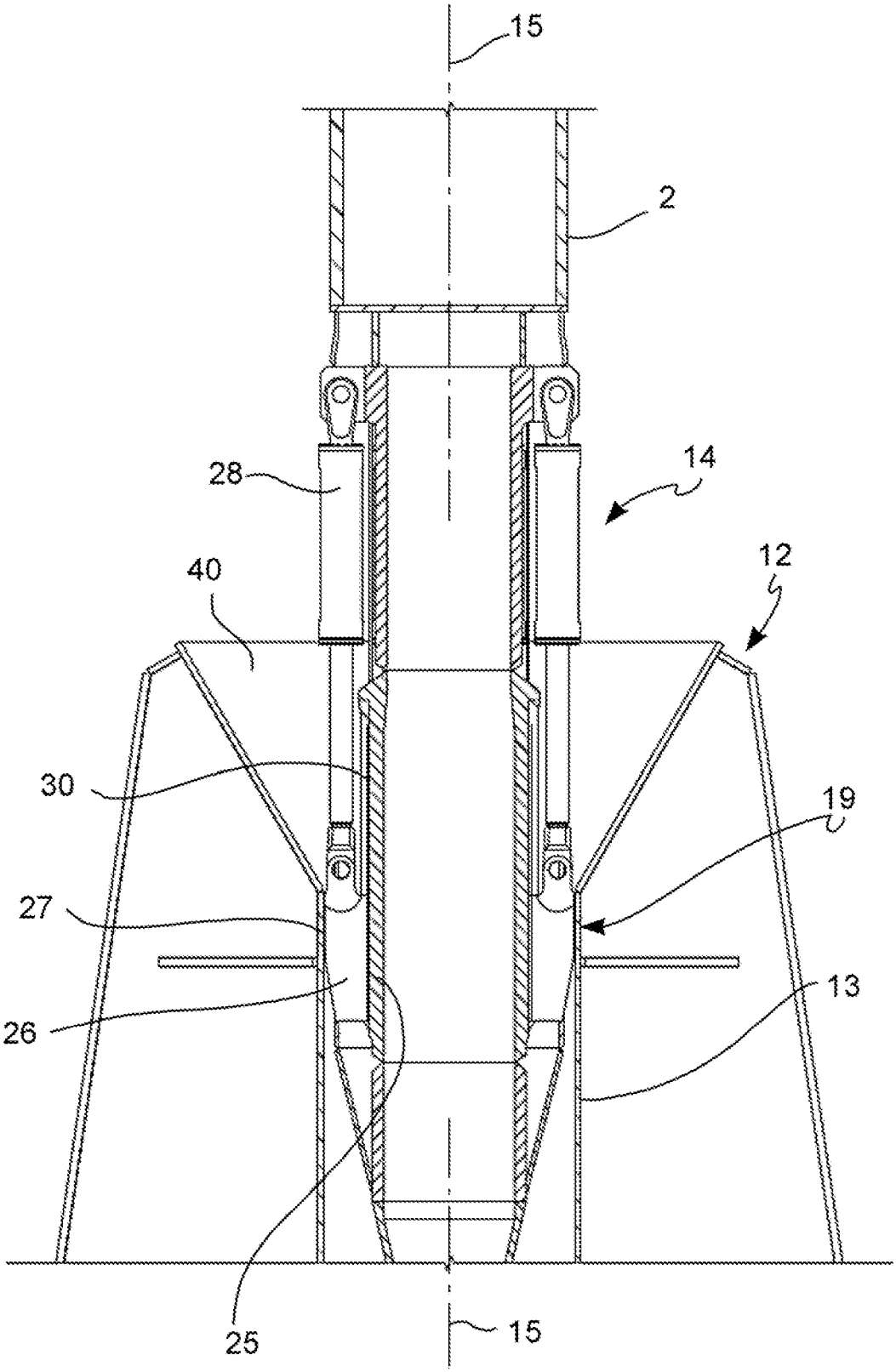

Alternatively (FIGS. 6 and 7), the expansion members 26 comprise one or more wedge-shaped blocks or plates, preferably one or more pairs of diametrically opposite wedge-shaped plates or blocks, arranged in a sliding manner on sliding tracks 30 parallel to the longitudinal direction of the head 14 so that a displacement of the wedge-shaped plates along the insertion direction 15 (either in or against the insertion direction of the head 14 in the seat 13) implies a radial displacement of an outer surface 32 of the wedge-shaped plates in pressing contact against the locking surface 27.

In both embodiments, by virtue of the extension in longitudinal direction of the inner 31 and outer 32 contact surfaces, of the locking surface 27 and of the corresponding pressing contact areas between the plates 26, the body of the head 14 and the seat 13, a pressure clamping is obtained distributed over a wide area, suited to transmit moments and to prevent relative rotations between the head 14 and the seat 13.

Furthermore, the longitudinal distance in the insertion direction 15 between the locking region 19 (locking portion 25 and locking surface 27) and the coupling region 17 (hooking portion 22 and latching portion 23), and a possible constraint against translations which are transverse to the insertion direction 15 in the coupling region 17, may further contribute to transmitting bending moments from the riser 2 to the supporting structure 10 and to the complete clamping of the coupling head 14 in the coupling seat 13.

In a preferred embodiment (FIG. 4, 5, 6, 7), the expansion member 26 is hinged (with hinge axis tangent to the longitudinal axis) to a first end of the linear actuator 28 the second end of which is hinged (with hinge axis tangent to the longitudinal axis) to the body of the coupling head 14, so as to accompany the movement and the movement deviation of the expansion members 26 without bending stresses on the actuator 28.

Figure 4:
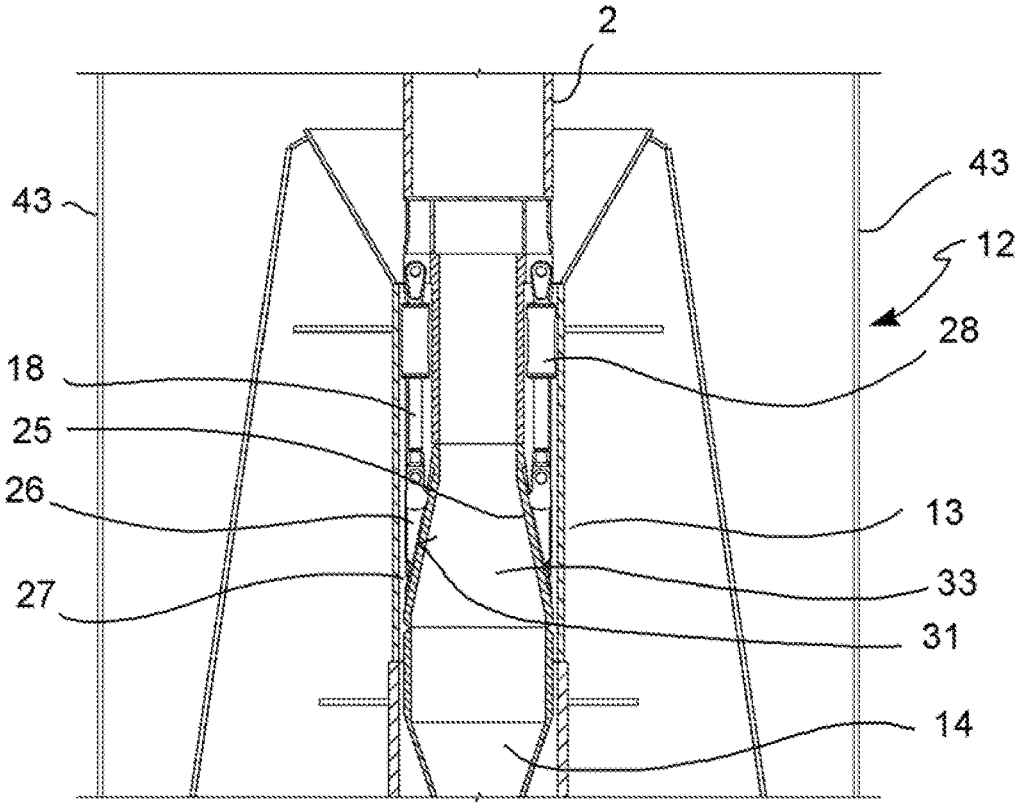
FIGS. 4 and 5 show a clamping connector of the coupling system in FIG. 2, in deactivated configuration (FIG. 4) and in activated configuration (FIG. 5)
Figure 5:
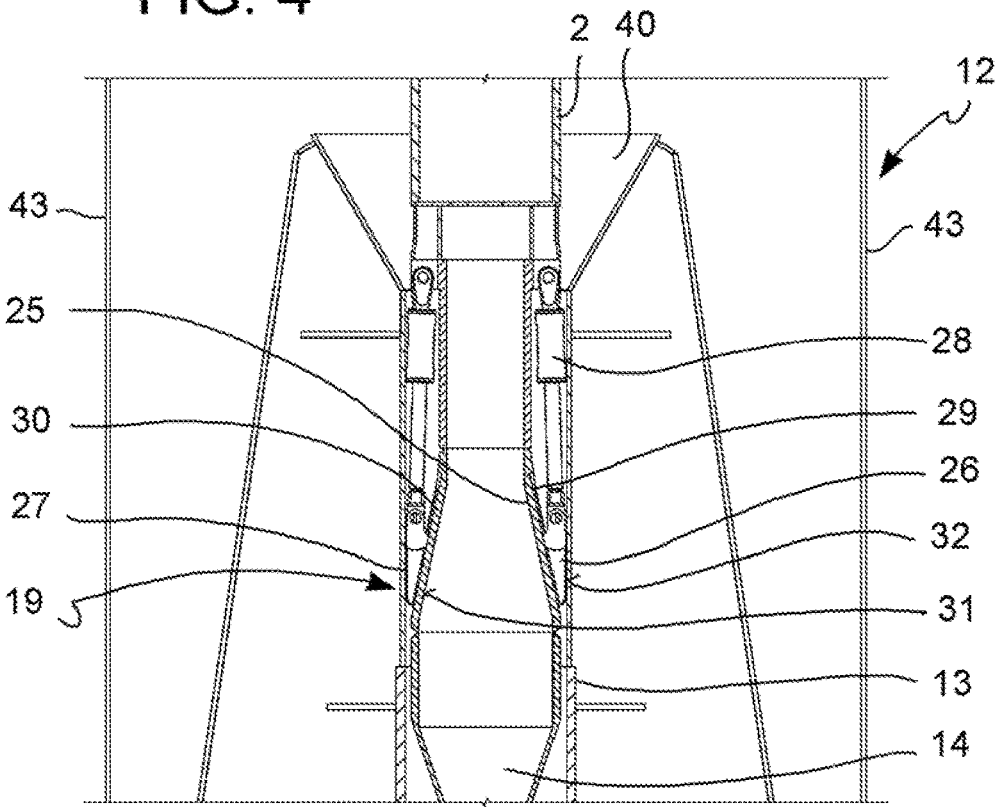

The locking portion 25 of the coupling head 14 may form a possibly tubular inner body 33 of substantially constant cross section, e.g. cylindrical (FIGS. 6 and 7), or with a first portion having substantial constant cross section, e.g. cylindrical, and a second portion having divergent cross section, e.g. frustum of a cone or a frustum of a pyramid, and acting as deviating means 29 (FIGS. 4, 5).

On the outer side of the inner body 33 sliding tracks 30 are formed, extending in the longitudinal direction and alternating with reinforcing and containment ribs 34, also extending in the longitudinal direction.

Figure 8:
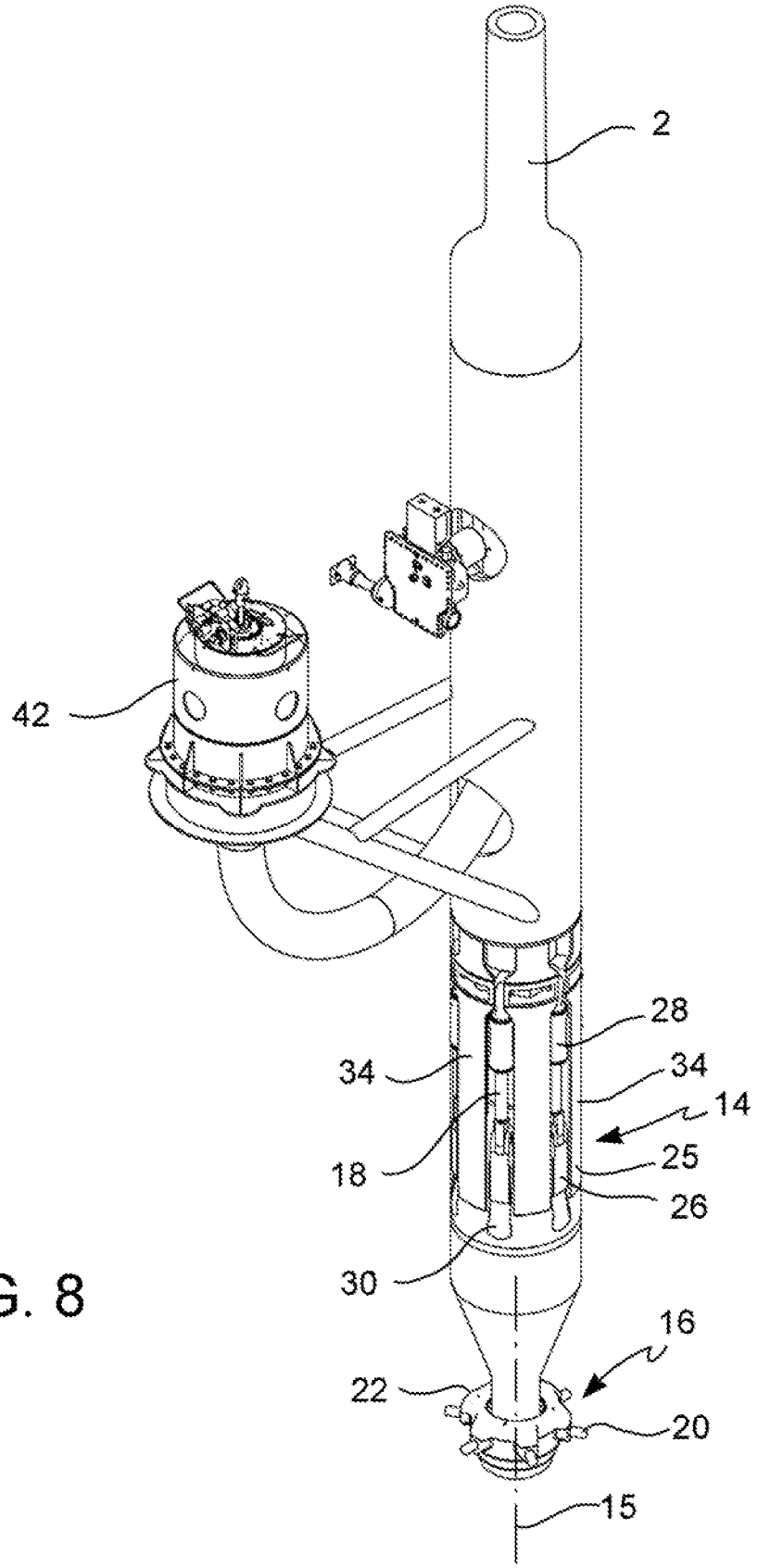
FIG. 8 shows an end portion of a riser with a connection interface for a submarine pipeline and with a coupling head of the system in FIG. 2, FIGS. 9 and 10 are longitudinal section views of a coupling system in detached position (FIG. 9) and inserted position (FIG. 10), according to a further embodiment.
Figure 9:
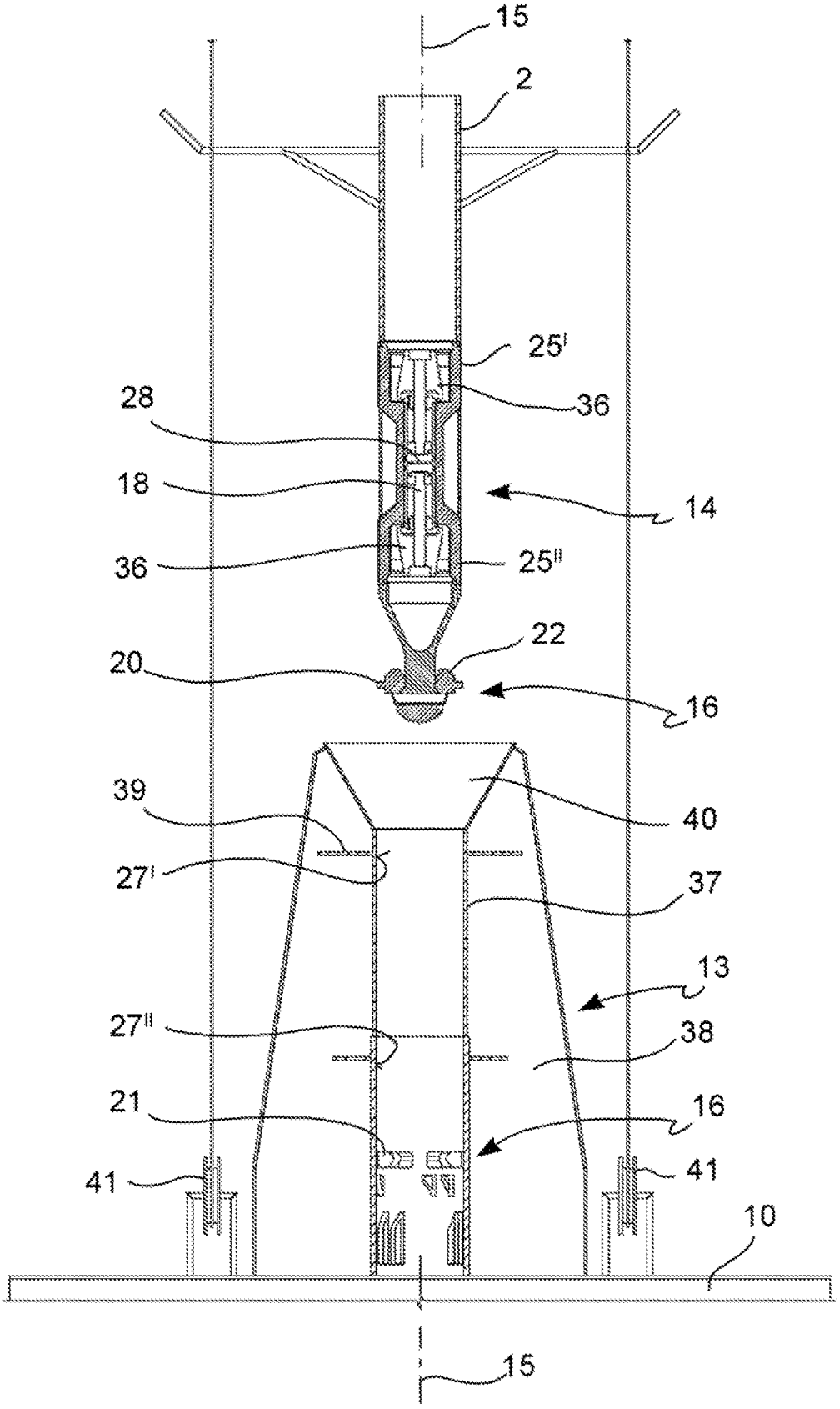
Figure 10:
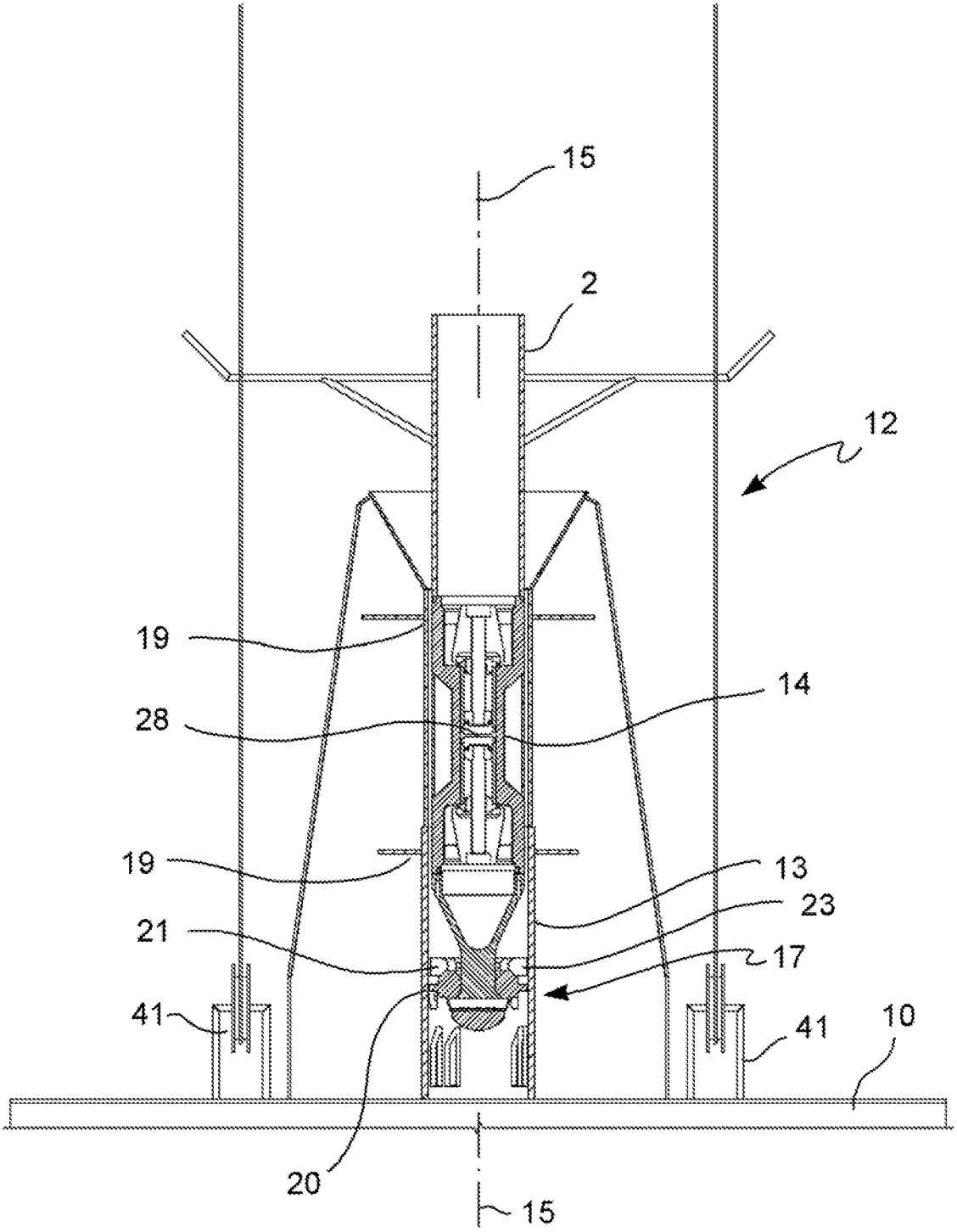

The reinforcement and containment ribs 34 are shaped to accommodate, at least partially or completely, the actuating means 28 (to protect them during the insertion of the head 14 in the seat 13) and the expansion members 26, and to support the expansion members 26 laterally and guide them in longitudinal direction along the sliding tracks 30 (FIG. 8).

In a further embodiment (FIGS. 9-13), the expansion members (26) comprise two groups of a plurality of members 26', 26" each arranged in two locking portions 25', 25" mutually spaced apart in the longitudinal direction, and radially displaceable between the retracted position and the protracted position, so as to provide two discrete pressing contact zones between the coupling head 14 and the coupling seat 13.

The radial pressing contact in two discrete zones spaced apart in the longitudinal direction transmits the bending moments of the riser 2 and achieves the complete clamping of the head 14 in the seat 13.

In an embodiment, each of said groups comprises a plurality of pins 26', 26" accommodated in holes 35 with radial orientation with respect to the longitudinal direction of the head 14 and arranged in a circumferential sequence about the two locking portions 25', 25".

Figure 11:
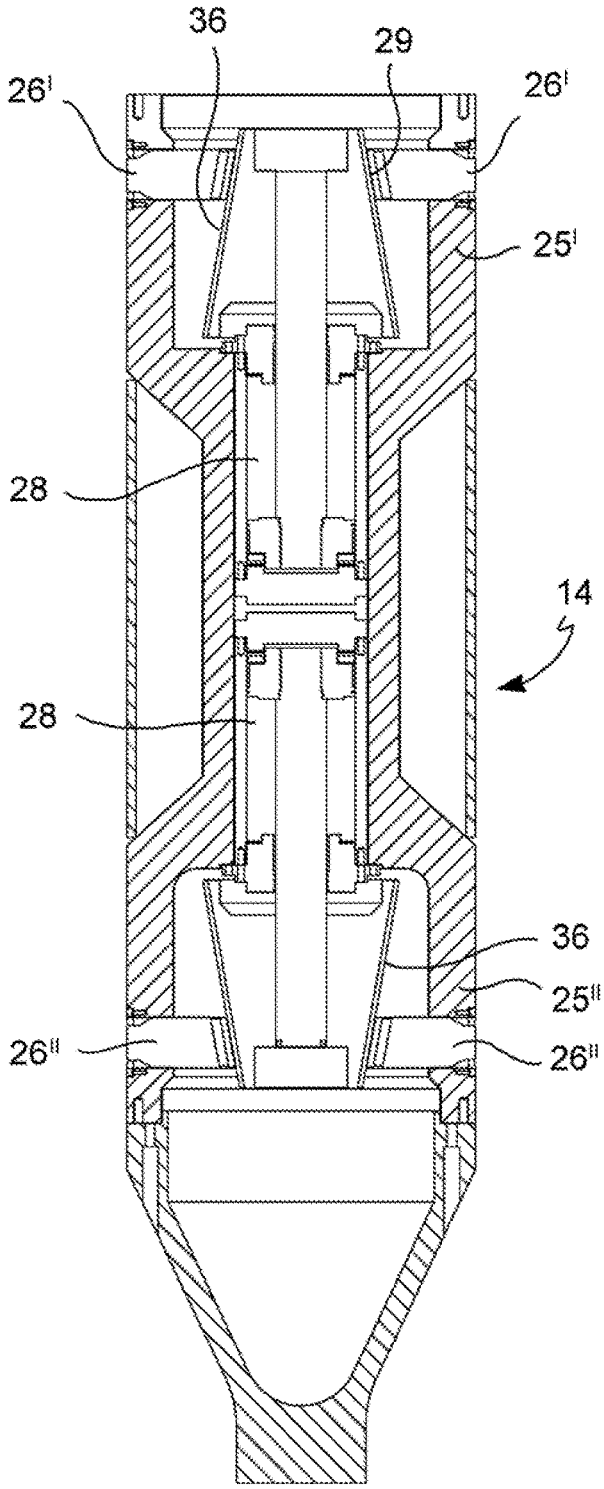
FIGS. 11 and 12 show a clamping connector of the coupling system in FIG. 9, in deactivated configuration (FIG. 11) and in activated configuration (FIG. 12)
Figure 12:
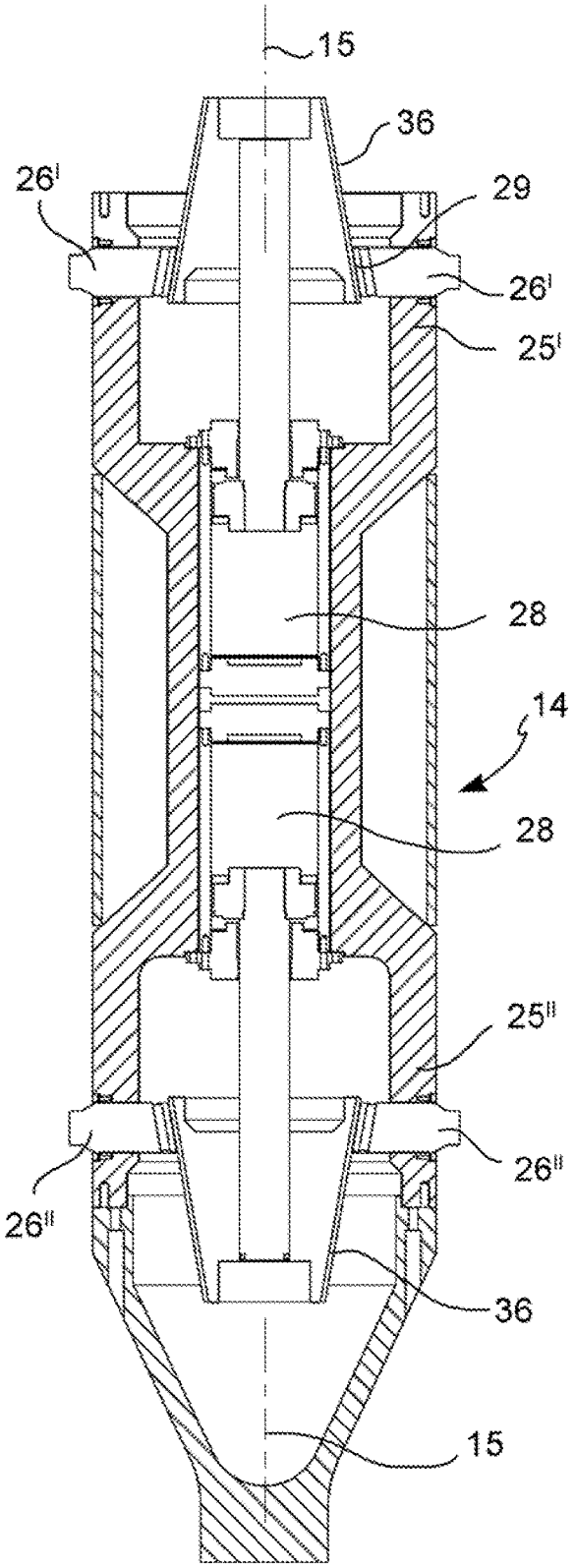
Figure 13:
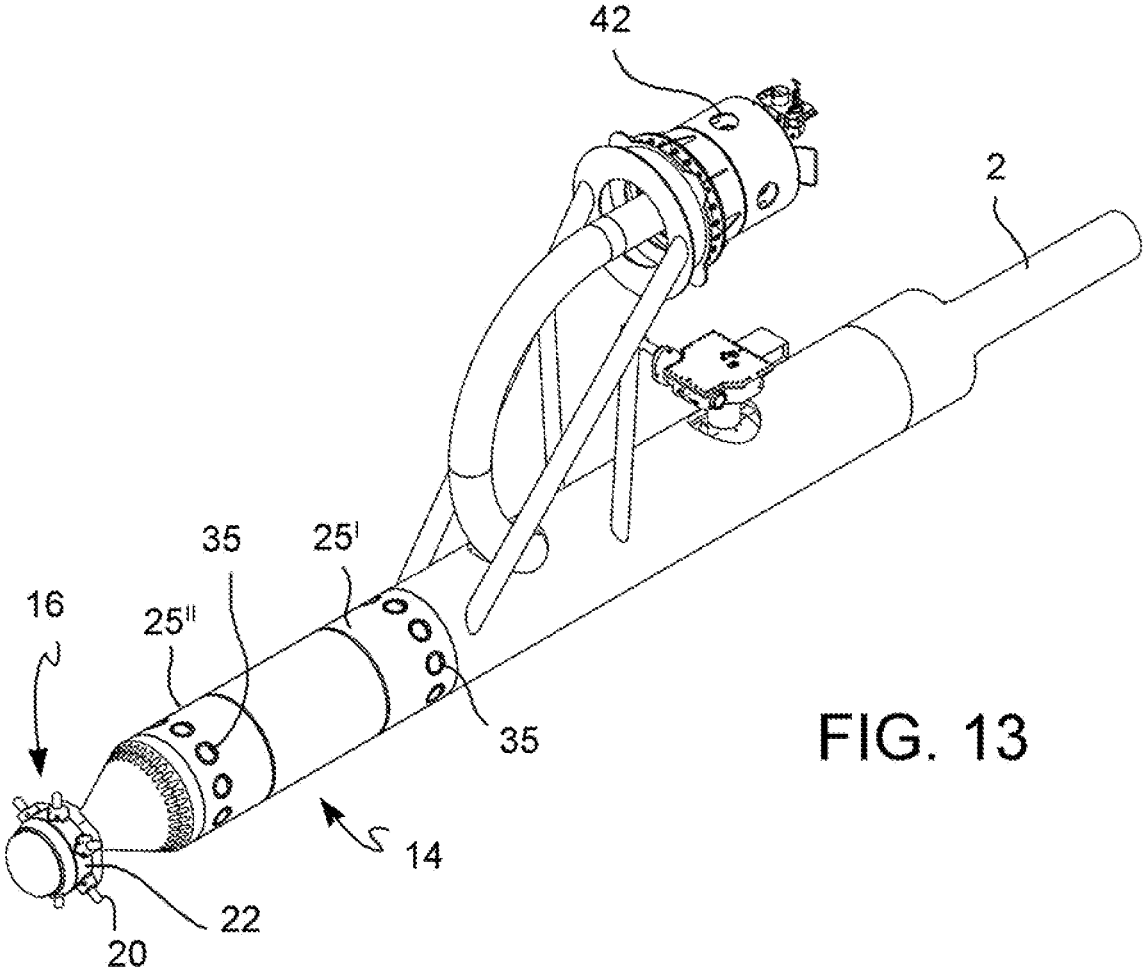
FIG. 13 shows an end portion of a riser with a connection interface for a submarine pipeline and with a coupling head of the system in FIG. 9.

The actuating means 28, e.g. linear actuators, preferably extend in the longitudinal direction and comprise a thrust member 36 displaceable in the longitudinal direction and having wedge-like surfaces inclined with respect to the longitudinal direction and which engage corresponding wedge-like surfaces of the members or pins 26', 26" so as to displace them from the retracted position to the protracted position. The thrust member 36 may have a truncated cone or truncated pyramid shape (FIGS. 11, 12).

The return of the expansion members 26, 26', 26" from the protracted position to the retracted position may occur by retro-activating the actuation means 28, on condition that the expansion members 26, 26', 26" are constrained to actuating means for a return movement thereof, either independently or biased toward the retracted position.

The actuating means 28 may be fixed aboard the coupling head 14 or reversibly connectable thereto, e.g. by means of a remotely operated underwater vehicle.

The coupling head 14 is preferably made of steel or steel combined with portions of composite material, e.g. reinforced with fibers. The coupling head 14 further comprises a connection portion for connecting to the riser 2, e.g. a circumferential edge provided for welding or bolting (and preferably flanged for this purpose).

As mentioned at the beginning of the description of the clamping connector 18, the actuation means 28 and the expansion members 26, instead of being arranged aboard the coupling head 14 and acting on the seat 13, may be arranged aboard the coupling seat 13 and act on the head 14. It is clear that this is not a trivial inversion, but this "reversed" embodiment is expressly contemplated by the inventors and can be advantageous or even indispensable in situations in which one end of the riser 2 and the head 14 constrained thereto must be particularly small or in which they undergo, before being permanently coupled to the underwater supporting structure 10, handling and biases which are incompatible with the presence of actuation mechanisms and of expansion members.

The coupling seat 13 may comprise a tubular inner wall 37, preferably cylindrical or with cylindrical portions, which form the latching members 21 and (where applicable) the clamping surface or surfaces 27, 27', 27". Longitudinal reinforcement walls 38 and possibly circumferential reinforcement walls 39 are formed on an outer side of the inner tubular wall 37, in particular at the locking region 19 and the locking surfaces 27, 27', 27".

The coupling seat 13 has a funnel-shaped guiding and centering portion 40 at an inlet opening for the head 14.

The coupling seat 13 further comprises a connecting portion for connecting to the supporting structure 10, e.g. a circumferential edge arranged for welding or bolting (and preferably flanged for this purpose).

Finally, the coupling seat 13 or the underwater supporting structure 10 may comprise auxiliary anchoring and pulling means, e.g. a pull winch 41, suited to collaborate, e.g. by means of a pull cable 43, with corresponding means, e.g. hooks, slots, pulleys, provided on the head 14 or on the riser 2, for a controlled approximation of the coupling head 14 to and into the coupling seat 13 (FIGS. 2, 3, 9, 10).

Hereinafter, the operation of the coupling system 12 will be described in the case of a riser installation of FSHR type.

A suction pile foundation 10 is installed as underwater supporting structure on the seabed 3, e.g. by means of an installation ship which may be the same ship which will be then used to assemble and install the riser 2. The coupling seat 13 with a vertical upward orientation is fixed to the foundation 10.

The riser 2 is assembled and lowered into the sea from the installation vessel. The upper end 5 of the riser 2 is hung to the floating body 8 which provides the necessary up thrust buoyancy force for a provisional retention of the riser 2 in a vertical position.

The coupling head 14, which is now located vertically directed towards the bottom of the sea, is fastened to the lower end portion of the riser 2.

The lower end portion of the riser 2 or the head 14 are connected with the cables of one or more pull winches 41 connected to the coupling seat 13 on the foundation 10. This operation is preferably performed by a remotely operated underwater vehicle (ROV).

By actuating the pull winches 41, they pull the riser 2 downwards, against the thrust force of the floating body 8, until the head 14 is inserted in the seat 13.

With the head 14 inserted in the seat 13, the pull connector 16 performs the provisional, pull-only connection between the head 14 and the coupling seat 13, e.g. by means of a roto-translation movement. By releasing the tension of the winches 41, the riser 2 rises until it stops due to the pull connector 16.

At this point, it is possible to adjust (increase) the buoyancy thrust force of the floating body 8 to its definitive operating value by de-ballasting.

Successively, preferably with the riser 2 moved only slightly and in nearly static condition, the clamping connector 18 is activated, e.g. by means of a remotely operated underwater vehicle, to carry out the complete clamping of the head 14 in the seat 13.

Afterwards, the pipeline 11 may be connected to a suitable pipeline connection interface 42 of the riser 2.

In order to satisfy contingent needs and specifications, those skilled in art may obviously make further changes and variations to the coupling device and method, which are all contained within the scope of protection of the invention as defined in the following claims.

The invention claimed is:

1. A coupling system between a riser and an underwater supporting structure, comprising:

a coupling seat and a coupling head, one of the coupling seat and the coupling head being connectable to the underwater supporting structure and the other of the coupling seat and the coupling head being connectable to the riser, wherein the coupling head and the coupling seat are shaped for a mutual insertion thereof along an insertion direction from a completely detached position to an inserted position, a pull connector constraining the coupling head to the coupling seat, in a coupling region to prevent extraction of the coupling head towards the detached position, but to allow rotation of the coupling head with respect to the coupling seat at least about axes transversal to the insertion direction, a clamping connector constraining the coupling head to the coupling seat, in at least one locking region spaced apart from the coupling region to prevent translation transversal to the insertion direction and rotation between the head and the coupling seat, wherein the pull connector and the clamping connector form a complete clamping of the coupling head in the coupling seat with prevention of relative rotation therebetween, wherein the pull connector is actuatable alone and independently from the clamping connector to make a provisional, pull-only connection between the head and the coupling seat, wherein the clamping connector is actuatable independently from the pull connector to allow postponing complete clamping with respect to the provisional connection;

expansion members arranged slidingly on sliding tracks;

reinforcement and containment ribs shaped to at least partially accommodate the actuator between the ribs and to support the expansion members laterally and guide the expansion members in the longitudinal direction along the sliding tracks.

2. The system according to claim 1, wherein the pull connector comprises one or more hooking members arranged in a hooking portion of the coupling head and engaging one or more latching members arranged in a latching portion of the coupling seat, wherein the latching members form an abutment for free resting of the hooking members in an extraction direction of the coupling head and allow movement of the coupling head in an opposite insertion direction, to provide clearance needed to allow angular orientations of the coupling head about axes transversal to the insertion direction.

3. The system according to claim 2, wherein the pull connector comprises labyrinth guiding surfaces for engagement of the hooking members and the latching members by relative roto-translation movement.

4. The system according to claim 2, wherein the coupling portion is formed at a free end of the coupling head, tapered with respect to the locking portion.

5. The system according to claim 1, wherein the clamping connector comprises the expansion members positioned in a locking portion of the coupling head and displaceable between a retracted position, in which the expansion members allow the head to move in the seat, and a protracted position, in which the expansion members expand the radial dimension of the head in pressing contact against a locking surface of the coupling seat.

6. The system according to claim 5, wherein the clamping connector comprises an actuator to displace the expansion members between the retracted position and the protracted position, wherein said actuator acts in a longitudinal direction of the coupling head which corresponds to the insertion direction and wherein deviating means are provided to convert the longitudinal thrust of the actuator into a transversal thrust of the expansion members.

7. The system-according to claim 5, wherein the expansion members comprise one or more wedge-shaped plates arranged slidingly on the sliding tracks inclined in a diverging manner, so that a displacement of the plates along the insertion direction brings about a radial displacement of the plates in pressing contact against the locking surface.

8. The system according to claim 7, wherein said plates provide pressing-contact areas between the plates, the head and the housing, extending in the longitudinal direction of the head.

9. The system according to claim 5, wherein the expansion members comprise one or more wedge-shaped plates slidingly arranged on the sliding tracks parallel to the longitudinal direction of the head, so that a displacement of the wedge-shaped plates in the longitudinal direction brings about a displacement of an external surface of the wedge-shaped plates in pressing contact against the locking surface.

10. The system according to claim 5, wherein the expansion member is hinged, with a hinge axis tangent to a longitudinal axis of the head, to a first end of a linear actuator the second end of which is hinged, with a hinge axis tangent to the longitudinal axis of the head, to the body of the coupling head, to effect movement and movement deviation of the expansion members without bending stresses on the actuator.

11. The system according to claim 5, wherein the expansion members comprise two groups of a plurality of members arranged in two locking portions mutually spaced apart in the longitudinal direction of the coupling head and radially displaceable between the retracted position and the protracted position, to provide two discrete pressing contact zones between the coupling head and the coupling seat.

12. The system according to claim 11, wherein each of said members are pins housed in holes with radial orientation with respect to the longitudinal direction of the head and arranged in a circumferential sequence about the two locking portions.

13. The system according to claim 12, wherein the actuator extends in the longitudinal direction and comprise a thrust member displaceable in the longitudinal direction and having wedge-like surfaces inclined with respect to the longitudinal direction and which engage corresponding wedge-like surfaces of the members to move the members from the retracted position to the protracted position.

14. The system according to claim 1, wherein the coupling seat comprises an inlet opening for the head with a funnel-shaped guiding and centering portion.

15. The system according to claim 1, wherein a locking portion of the coupling head forms a tubular inner body, wherein the sliding tracks are on an outer side of the tubular inner body and extend in the longitudinal direction alternating with the reinforcement and containment ribs, extending in the longitudinal direction.

16. The system according to claim 1, wherein the clamping connector comprises the expansion members positioned in a locking portion of the coupling head, wherein the expansion members comprise one or more wedge-shaped plates arranged slidingly on the sliding tracks inclined in a diverging manner, so that a displacement of the plates along the insertion direction brings about a radial displacement of the plates in pressing contact against the locking surface.

17. A coupling system between a riser and an underwater supporting structure, comprising:

a coupling seat and a coupling head, one of the coupling seat and the coupling head being connectable to the underwater supporting structure and the other of the coupling seat and the coupling head being connectable to the riser;

wherein the coupling head and the coupling seat are shaped for a mutual insertion thereof along an insertion direction from a completely detached position to an inserted position;

a pull connector constraining the coupling head to the coupling seat, in a coupling region to prevent extraction of the coupling head towards the detached position, but to allow rotation of the coupling head with respect to the coupling seat at least about axes transversal to the insertion direction;

a clamping connector constraining the coupling head to the coupling seat, in at least one locking region spaced apart from the coupling region to prevent translation transversal to the insertion direction and rotation between the head and the coupling seat;

wherein the pull connector and the clamping connector form a complete clamping of the coupling head in the coupling seat with prevention of relative rotation therebetween;

wherein the pull connector is actuatable alone and independently from the clamping connector to make a provisional, pull-only connection between the head and the coupling seat;

wherein the clamping connector is actuatable independently from the pull connector to allow postponing complete clamping with respect to the provisional connection;

wherein the clamping connector comprises expansion members positioned in a locking portion of the coupling head and displaceable between a retracted position, in which the expansion members allow the head to move in the seat, and a protracted position, in which the expansion members expand the radial dimension of the head in pressing contact against a locking surface of the coupling seat;

wherein the expansion members comprise one or more wedge-shaped plates arranged slidingly on the sliding tracks inclined in a diverging manner, so that a displacement of the plates along the insertion direction brings about a radial displacement of the plates in pressing contact against the locking surface;

wherein the locking portion of the coupling head forms a tubular inner body, on an outer side of which the sliding tracks are formed and extended in the longitudinal direction and alternating with reinforcement and containment ribs, extending in longitudinal direction, said reinforcement and containment ribs being shaped to at least partially accommodate the actuator between the ribs and to support the expansion members laterally and guide the expansion members in the longitudinal direction along the sliding tracks.

* * * * *